US006405465B2

(12) United States Patent
Dwyer et al.

(10) Patent No.: US 6,405,465 B2
(45) Date of Patent: Jun. 18, 2002

(54) MAGNETICALLY MOUNTED BOARD FOR DISPLAYING FLAT ARTICLES

(75) Inventors: Stephen Harry Dwyer, Woodbury; Kollin Ignatius Schammel, Eagan; Sheila Gerette Dwyer, Woodbury, all of MN (US)

(73) Assignee: Fridge Frame Inc., St. Paul, MN (US)

( * ) Notice: Subject to any disclaimer, the term of this patent is extended or adjusted under 35 U.S.C. 154(b) by 0 days.

(21) Appl. No.: 09/323,356

(22) Filed: Jun. 1, 1999

Related U.S. Application Data

(60) Provisional application No. 60/088,471, filed on Jun. 8, 1998.

(51) Int. Cl.[7] ..... G09F 7/12; G09F 7/04

(52) U.S. Cl. ..... 40/594; 40/600; 40/107; 40/772

(58) Field of Search ..... 40/594, 600, 772, 40/107, 119, 611, 657, 661, 661.01; 434/428, 430; D20/42

(56) References Cited

U.S. PATENT DOCUMENTS

| | | | | | |
|---|---|---|---|---|---|
| 2,886,907 | A | * | 5/1959 | Stephenson | 40/772 X |
| 2,914,873 | A | * | 12/1959 | Brennan | 40/594 |
| 3,581,423 | A | * | 6/1971 | Mascolo | 40/772 |
| 4,083,137 | A | * | 4/1978 | Rozmanith | 40/772 |
| 4,741,119 | A | * | 5/1988 | Baryla | 40/594 |
| 4,852,282 | A | | 8/1989 | Selman | 40/600 X |
| D337,663 | S | | 7/1993 | Castellanos | |
| 5,248,536 | A | * | 9/1993 | DuKatz | 40/594 X |
| 5,303,489 | A | | 4/1994 | Blegen | |
| 5,342,665 | A | * | 8/1994 | Krawitz | 40/600 X |
| 5,375,351 | A | | 12/1994 | King et al. | 40/711 X |
| 5,495,686 | A | | 3/1996 | Millard et al. | |
| 5,682,695 | A | * | 11/1997 | Hoffman | 40/594 |
| 5,727,766 | A | * | 3/1998 | Mayo | 40/772 X |
| 6,067,738 | A | * | 5/2000 | Zeligson | 40/611 |

* cited by examiner

*Primary Examiner*—Brian K. Green

(57) ABSTRACT

A magnetically mounted display board has a rear surface providing magnetic support, a display panel which removably holds flat articles for display, and a transparent protectant for viewing and protection of the displayed articles. The display panel and the transparent protectant are bound together with a binding tape. This allows one to display photos, childrens artwork, calendars, post cards and other flat articles on a refrigerator in a creative, organized and protected fashion.

15 Claims, 1 Drawing Sheet

MAGNETICALLY MOUNTED BOARD FOR DISPLAYING FLAT ARTICLES

This patent application claims the benefit of prior filed copending provisional patent No. 60/088,471 filed Jun. 8, 1998.

BACKGROUND OF THE INVENTION

1) Field of the Invention

The present invention is directed to a suitable method of organizing protecting, displaying and framing household, school, and office display articles.

2) Description of Prior Art

Various magnets have been developed to mount articles to objects such as a refrigerator door.

Summary Of Invention

According to the present invention, the display board is comprised of a display panel at transparent protective sheet, and one or more magnetic support members. The display board may include an adhesive, which allows for the removability of the display articles. The magnetic support member may comprise of four magnets, one in each corner of the display board. The display board may have printed designs along the periphery of the display panel or the protective sheet to allow for creative designs or seasonal themes.

The display panel area is ideally suited for a collection of flat articles spaced adequately apart from each other to allow the protective sheet to removably adhere to the display panel. The lift off force of the protective sheet and flat articles from the display panel should be less than the magnetic support member lift off force from the magnetically attractive surface.

The method of displaying articles using this display board is to place the magnetic support members on a magnetically attractive surface; peel the protective sheet away from the display panel; position an article on the display panel; and replace the protective sheet over the article and the display panel. By designing the display panel to extend approximately ⅜ inch past the length of the protective sheet and by extending the protective sheet approximately ⅛ inch past the adhesive it provides for easy lift off of protective sheet and an area for imprinting, product identification or other such labeling.

DESCRIPTION OF THE PREFERRED EMBODIMENTS

Figure 1:
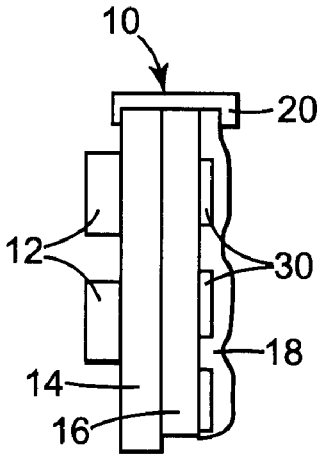
FIG. 1 is a side view of a display board according to one embodiment of the present invention.

A magnetically mounted display board 10 according to one embodiment of the present invention is shown in side view in FIG. 1. Display board 10 comprises one or more magnetic support members 12, a display panel 14, optional adhesive 16, and transparent protective layer 18. Elements 12, 14, and 18 may be secured together at one edge by a binder 20 or elements 14 & 18 may be secured together at one edge by a binder 20.

Articles 30 to be displayed are provided between display panel 14 and protective layer 18.

Figure 2:
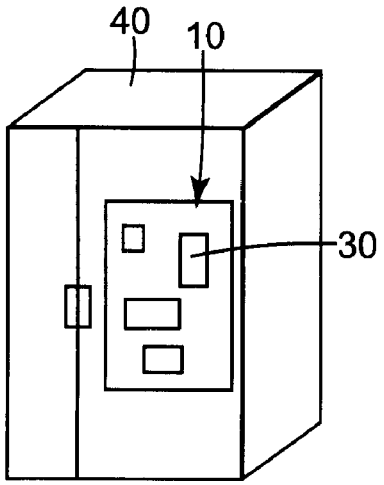
FIG. 2 is a front isometric view of a refrigerator having the display board of FIG. 1 magnetically mounted to it.

Display board 10 may be magnetically secured by magnetic support members 12 to any magnetically attractive surface, such as a refrigerator, 40 as shown in FIG. 2.

Figure 3:
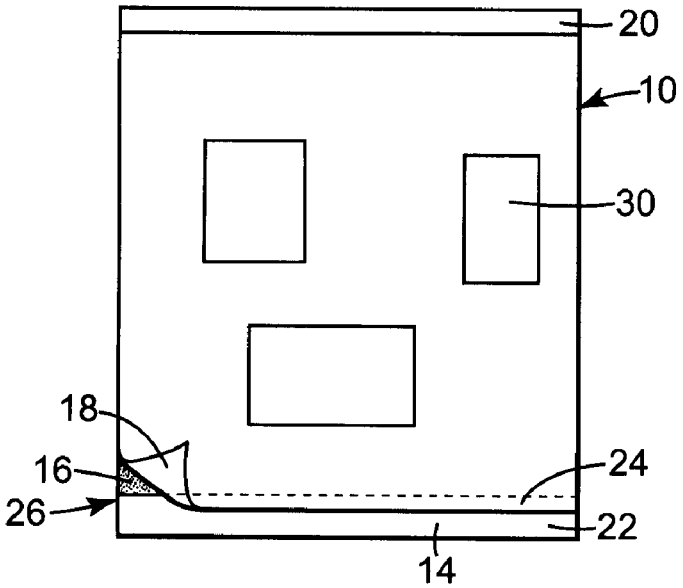
FIG. 3 is a front view of the display board of FIG. 1.

As shown in FIG. 3, display board 10 may have a display panel 14 which is longer than protective layer 18, thereby allowing an area 22 for product labeling or printing. Additionally, the length of optional adhesive layer 16 may be shorter than the length of protective layer 18, thereby creating region 24. This allows for the easy peeling off of protective layer 18 from adhesive layer 16 at corner 26, as shown in FIG. 3.

Magnetic support member 12 may be a flat magnet, such as a 20 or 30 or 40 thousands of an inch thick flat magnet obtainable from various magnet suppliers.

Display panel 14 may be a card stock with adhesive, or flat magnet (see above) with adhesive, or a statically attractive material, such as 16 point or 20 lb. card stock with adhesive, a 40 thousands of an inch thick flat magnet with adhesive, or a static cling like material.

Optional adhesive layer 16 may be an acrylic adhesive, such as a low tack acrylic adhesive that is coated or provided as a transfer adhesive, preferably allowing for removeability of display articles.

Protective layer 18 should be a transparent sheet, such as a 2 thousands of an inch thick polyester or polyproylene plastic or pvc film. Preferably low-kink, pliable, and ph nuetral to allow for archivability of display articles.

Protective layer 18 should be secured along an edge of display board 10 so that the protective layer may be peeled off of display panel 14 to allow the user to insert, remove, and exchange articles 30 being displayed on the display board. Materials used to secure this edge may be a binding material like that used on Hallmark brand photo album pages, available from Hallmark Cards Inc., Kansas City, Mo., as product number AR6555 or VPC binding tape, available from Vital Presentation Concepts, Inc., St. Paul, Minn., as product number #788WIP788.

It will thus be seen that the present invention provides a product and method to removably display, frame, position, organize, and protect a plurality of display articles such as photos, calendars, current events, schedules, children's art, etc. . . on any magnetically attractive surface. In addition, the present invention enhances interaction with display articles without destruction of the display articles by touch, scratch, or without otherwise dirtying, damaging or destroying display articles.

What is claimed:

1. A method of displaying at least one article on a refrigerator, comprising the steps of:

providing a display board comprising:

a display panel, having a flat front surface, secured to at least one magnetic support member for securing the display board to a refrigerator having a magnetically attractive surface; and a pliable, transparent protective sheet, wherein at least one flat article may be removably displayed between the flat front surface of the display panel and the pliable, protective sheet, and wherein the pliable, protective sheet is secured to the display panel along a side edge of the display panel and is otherwise removably secured to the display panel with an adhesive so that the pliable, protective sheet is removably secured to the front surface of the display panel over its area;

placing the at least one magnetic support member on a magnetically attractive surface of a refrigerator;

peeling the pliable, protective sheet away from the flat front surface of the display panel;

positioning at least one flat article anywhere on the flat front surface of the display panel irrespective of the shape or orientation of the at least one flat article on the flat front surface of the display panel; and replacing the pliable, protective sheet over the at least one flat article and the display panel.

2. The method of claim 1, wherein the adhesive securing the at least one flat article to the display panel allows for removability of the at least one flat article.

3. The method of claim 1, wherein the at least one magnetic support member comprises at least four planar magnets.

4. The method of claim 1, wherein the adhesive ends approximately ½" short of one edge, and the protective sheet ends approximately ⅜" short of the same edge to allow for easy lift-off of the protective sheet and an area for imprinting, product identification or other such labeling.

5. The method of claim 1, wherein the at least one flat article includes a calendar.

6. The method of claim 1, wherein a first lift-off force is required to separate the display board from the refrigerator and a second lift-off force is required to peel the pliable, protective sheet from the flat front surface of the display panel, and wherein the second lift-off force is less than the first lift-off force.

7. The method of claim 1, wherein a first lift-off force is required to separate the display board from the refrigerator and a second lift-off force is required to remove the at least one flat article from the flat front surface of the display panel, and wherein the second lift-off force is less than the first lift-off force.

8. The method of claim 1, wherein the pliable, protective sheet is a polyester film.

9. A method of displaying a calendar on a refrigerator, comprising the steps of:

providing a display board comprising:

a display panel, having a flat front surface, secured to at least one magnetic support member for securing the display board to a magnetically attractive surface of a refrigerator; and a pliable, transparent protective sheet, wherein a calendar may be removably displayed between the flat front surface of the display panel and the pliable, protective sheet, and wherein the pliable, protective sheet is secured to the display panel along a side edge of the display panel and is otherwise removably secured to the display panel with an adhesive so that the pliable, protective sheet is removably secured to the front surface of the display panel over its area;

placing the at least one magnetic support member on a magnetically attractive surface of a refrigerator;

peeling the pliable, protective sheet away from the flat front surface of the display panel;

positioning a calendar anywhere on the flat front surface of the display panel irrespective of the shape or orientation of the calendar on the flat front surface of the display panel; and replacing the pliable, protective sheet over the calendar and the display panel.

10. The method of claim 9, wherein the adhesive allows for removability of the calendar.

11. The method of claim 9, wherein the at least one magnetic support member comprises at least four planar magnets.

12. The method of claim 9, wherein the adhesive ends approximately ½" short of one edge, and the protective sheet ends approximately ⅜" short of the same edge to allow for easy lift-off of the protective sheet and an area for imprinting, product identification, or other such labeling.

13. The method of claim 9 wherein a first lift-off force is required to separate the display board from the refrigerator and a second lift-off force is required to peel the pliable, protective sheet from the flat front surface of the display panel, and wherein the second lift-off force is less than the first lift-off force.

14. The method of claim 9, wherein a first lift-off force is required to separate the display board from the refrigerator and a second lift-off force is required to remove the calendar from the flat front surface of the display panel, and wherein the second lift-off force is less than the first lift-off force.

15. The method of claim 9, wherein the pliable, protective sheet is a polyester film.

* * * * *